US005507402A

United States Patent [19]

Clark

[11] Patent Number: 5,507,402

[45] Date of Patent: Apr. 16, 1996

[54] PLASTIC BOTTLE WITH A SELF SUPPORTING BASE STRUCTURE

[75] Inventor: Roger W. Clark, Castle Hill, Australia

[73] Assignee: ACI Operations Pty. Ltd., Melbourne, Australia

[21] Appl. No.: 238,244

[22] Filed: May 4, 1994

[30] Foreign Application Priority Data

May 5, 1993 [AU] Australia ..... PL8630

[51] Int. Cl.[6] ..... B65D 1/02; B65D 23/00

[52] U.S. Cl. ..... 215/375; 220/606; 220/608

[58] Field of Search ..... 220/606, 608, 220/609; 215/1 C, 375

[56] References Cited

U.S. PATENT DOCUMENTS

| | | | |
|---|---|---|---|
| 3,598,270 | 8/1971 | Adomaltis et al. | 215/1 C |
| 3,727,783 | 4/1973 | Carmichael | 215/1 C |
| 4,134,510 | 1/1979 | Chang | 215/1 C |
| 4,247,012 | 1/1981 | Alberghini | 215/1 C |
| 4,249,667 | 2/1981 | Pocock et al. | 215/1 C |
| 4,294,366 | 10/1981 | Chang | 215/1 C |
| 4,355,728 | 10/1982 | Yoshino et al. | 215/1 C |
| 4,785,949 | 11/1988 | Krishnakumar et al. | 215/1 C |
| 4,865,206 | 9/1989 | Behm et al. | 215/1 C |
| 4,867,323 | 9/1989 | Powers | 215/1 C |
| 4,978,015 | 12/1990 | Walker | 215/1 C |
| 5,024,340 | 6/1991 | Alberghini et al. | 215/1 C |

FOREIGN PATENT DOCUMENTS

| | | |
|---|---|---|
| A37948/89 | 1/1990 | Australia . |
| A62561/90 | 1/1992 | Australia . |
| 0244128A3 | 11/1987 | European Pat. Off. . |

*Primary Examiner*—Sue A. Weaver

*Attorney, Agent, or Firm*—Merchant, Gould, Smith, Edell, Welter & Schmidt

[57] ABSTRACT

A plastics container includes a neck and an outlet opening, a container body and a base; the base comprising a plurality of circumferentially spaced legs, each leg terminating in a foot portion on which the container is adapted to stand wherein each leg is provided with at least one longitudinally inwardly extending crease. Preferably each leg is provided with a single crease which extends downwardly and inwardly at least to the extent necessary so to substantially divide the foot portion of each leg into two separate support portions on which the container is adapted to stand.

18 Claims, 2 Drawing Sheets

PLASTIC BOTTLE WITH A SELF SUPPORTING BASE STRUCTURE

This invention relates to a bottle or container from a plastics material which is suitable for holding beverages and the like.

Without limiting the scope of the present invention, the container is particularly suitable for use in holding carbonated soft drinks and the invention is hereafter described with reference to this application. Various plastics materials have, particularly in the last decade, replaced glass as the materials of first choice for the manufacture of containers for beverages. In connection with carbonated beverages, the use of a particular polyester, namely polyethylene terephthalate (PET), has almost entirely replaced glass except in connection with some of the smaller sized containers. There are immediate advantages in the use of such plastics materials (e.g. reduced weight, improved safely on breakage, manufacturing cost) but there have been difficulties in producing a stable yet strong container which can be simply produced. Apart from PET, other suitable materials for the manufacture of such bottles include acrylonitrile, polyarylate and polycarbonates. The first generation polyester bottles were two piece bottles comprising a blow moulded bottle with a hemispherical base supported in a cup made from a thermoplastic material which was adhered to the base of the bottle. These bottles were cumbersome to make, included an unsightly non-transparent base and made re-cycling of the materials after use difficult.

The problem of creating a self supporting unitary structure was first overcome by the development of various "footed" base designs. These bottles were modified on blow moulding so that the base formed included a number of feet on which the bottle was adapted to stand. Different manufacturers developed different footed base designs. Whilst four and five foot configurations (i.e. four or five equally spaced feet spaced about the circumference of the base each separated by ribs) are currently in use be a number of manufacturers a number of other designs and variations have been proposed in the past comprising different spacings, sizes, shapes and configurations of the feet, legs and ribs of such self supporting bottles so to improve stability, aesthetic appearance and resistance to creep and stress cracking.

Whilst it is possible to make a footed bottle having good strength and stability using known base configuration designs when no limit is placed on the amount of plastics material utilized for each container, commercial realities dictate the need to maintain and if possible reduce the amount of raw plastics material used. Thus, it is commercially important that the container have the desired characteristics of strength and stability whilst minimizing the amount of plastics material used for each container.

One difficulty in producing a base configuration which meets all of the abovementioned desired attributes arises due to the competing nature of these attributes and the commercial need to use minimal plastics material for each container. For example, if one concentrates on improving bottle stability through enlarging the contact area of the respective feet, this will have a deleterious effect on the capacity of the bottle to resist creep under standard carbonation pressures. Furthermore, increasing the size of the feet requires narrowing of ribs between legs or a reduction in the number legs. Reducing the thickness of the walls of the leg and foot also leads to an increased likelihood that the leg will fail due to creep.

It is an object of the present invention to provide a unitary plastics container comprising a footed base configuration which has improved stability which is not adversely affected (in aesthetic or functional aspects) after filling under normal beverage carbonation pressures.

SUMMARY OF THE INVENTION

In accordance with the present invention, there is provided a plastics container comprising a neck and an outlet opening, a container body and a base, said base comprising a plurality of circumferentially spaced legs, each said leg terminating in a foot portion on which the container is adapted to stand wherein each leg is provided with at least one longitudinal inwardly extending crease.

Preferably, a single crease in each of the legs is provided which extends downwardly and inwardly at least to the extent necessary so to substantially divide the foot portion of each leg into two separate support portions on which the container is adapted to stand when standing upright on a level surface.

For the purpose of this specification and the appended claims a foot of the container is any one of those parts of the container adapted to contact a level surface when the container stands upright after it has been filled with a carbonated beverage. If the container has two or more separate support portions for each leg, the foot in each case is to be construed as the portion of the leg in an envelope drawn around the contact portions on the respective leg. The foot has an outer edge closer to the container and an inner edge closer to the center of the base.

Preferably, each of the legs of the base of the container includes a front wall which extends downwardly from the body of the container to the foot portion, and a base portion which extends from the foot portion towards the center of the base. The base portions is that part of the leg which extends from the inner edge of the foot portion towards the center of the base that does not contact a level surface after the container has been filled with a carbonated beverage.

Immediately after the manufacture of a container in accordance with this invention there is substantially point contact over a circle of radius R when the container is standing on a flat surface. On filling, the contact area is an annulus bounded by an outer radius R+X and an inner radius R–X. For a 1.25 liter container, X is about 2 mm immediately after filling. On extended storage especially at elevated temperature the contact area will change to some extent due to creep. For the purpose of this specifications the contact area is any part of the leg which contacts a level surface at any time during normal use. The rise and position of the contact area is affected by the shape of the leg and may be found by simple experiment.

Preferably the crease on each leg does not extend substantially into the base portion of the leg. Thus, in such an embodiment the major part of the base portion of each leg is smooth and uninterrupted. The center of the base may be simply that part of the base where the base portion of each of the legs meet. However, preferably the center of the base is in the form of a hemispherical dome and the base portions of each leg extend from the inner edges of the foot portions of each legs to the dome.

The crease can extend longitudinally up the full extent of the leg front wall but preferably does not extend more than about one third of the distance up this wall. Most preferably it extends up the front wall significantly less than this. The crease is preferably substantially "V" shaped in cross-section coming to a point or a flat narrow rib at the innermost point.

Although the invention is of value to all designs of bottles with a legged base, it is or particular value to petaloid bases. By petaloid we mean a base comprising of three or more legs each leg of which comprises two side walls, a front wall which reduces in width towards the base and which terminates in a foot on which the bottle may stand and wherein the front wall of the leg is conventionally gradually curved to a point known as the "tangent point" below which point the front wall curves with a substantially reduced radius of curvature to the outer edge of the foot portion where it terminates. (In this specification and the appended claims, the portion of the leg between the tangent point and the outer edge of the foot is called the "small radiused portion" of the leg). From the inner edge of the foot portion there is further provided an inner portion of the leg which extends inwardly towards the center of the base (otherwise known as the dome) and which makes no contact during normal use with a flat surface on which the container is standing when the bottle is standing upright.

In such embodiment, the crease in each leg of the container preferably extends substantially longitudinally along most of the small radiused portion of the leg. Most preferably, it extends from some point in the foot portion to at least the tangent point.

The inclusion of such a crease in the legs of the container base has been found by the applicants to have a number of benefits over a conventional non-creased profile. In particular, the applicants have found that the crease reinforces the leg and enables control of deformation caused by creep when the bottle is subjected to carbonation pressures. In bottle configurations comprising a high number of narrow legs (e.g. six legs with separating ribs), the incidence of creep in the leg under normal carbonation pressures would not usually present significant problems. However, where the leg has a greater surface area, and particularly where 5 or fewer legs are utilized, and the leg side wall is thin, the applicants have found that creep can lead to significant aesthetic and functional problems.

These problems of creep are usually manifested by bulges, folds and creases appearing towards the bottom of the foot. Without utilizing the profile of the present invention, these distortions in the leg profile are random and non uniform. If the creasing is pronounced, this can lead to non uniform (and hence less stable) bottle support. For example, it is possible that one leg may suffer more serious deformation than other legs which can result in the support on that leg being formed by the outward ridge caused by bottle creep. This can occur to a differing extent in different places on different legs on the same bottle. The bottle may not therefore stand as evenly (and thus will be less stable) and the leg supported on the outward ridge is more likely to fail due to stress cracking on dropping or other abuse. These problems are highlighted in the comparative example detailed later in this specification.

The applicants have found that the utilization of the crease in the respective legs of the container base enables the control of the effects of creep (which still occurs on filling under pressure). The variable distortion caused by the creep occurs mainly in the crease area and the portion of the foot in contact with a level surface moves in a substantially uniform manner over all the feet of the bottle. This alleviates the problems of randomly appearing creases which are unaesthetic and give the appearance of product design failure and encourages uniform support of the bottle on two uniformly spaced support portions.

Preferably, the crease is located centrally down the leg such that in, for example, a petaloid foot design, the crease runs longitudinally down the middle of the front wall of the leg. The Applicants have not found any significant benefit in extending the crease substantially beyond the inner edge of the foot portion or substantially beyond the tangent point.

In general, the bottles of the present invention are blown from a preform which has been injection moulded. Such bottles are blown on apparatus which generally can apply blowing pressures up to about 40 bar. To avoid the use of special equipment utilizing higher blowing pressures it is preferable to limit the extent and depth of the longitudinal crease on each leg. If the crease is too deep, wide or long, the applicants have found that it is not possible on conventional apparatus to blow out the bottom corners of the container legs adjacent to the foot portion. Thus, preferably the crease on each leg is not of greater length, depth or width which would prevent the full blowing out of the bottom corners of the feet of the container when blown at a pressure of 40 bar. Persons skilled in the art will be well able to modify the length, width and depth of such creases as a matter of routine trial so to meet this requirement.

Preferably, the width to depth ratio of the crease in at least the small radiused portion of the leg is from about 1:1 to about 3:1. If the ratio is much smaller than this formability of the base becomes difficult. If the ratio is much larger than this, the crease may not control the position of deformation in the leg due to creep. The width of the crease is preferably between 5 to 20% of the width of the foot.

It is preferred that in a bottle of a capacity of between 1.0 to 2.0 liters that the crease would be between 0.5 to 3.0 mm in depth in that portion of the crease of maximum depth. When a petaloid base configuration is used, the maximum depth of the crease is preferably located in the small radiused portion of the leg. The optimum depth of the crease depends to some extent on the thickness of the material forming the legs of the container and the contact area of the respective feet. If the contact area of the respective feet is large (for example when the container has four feet or five feet with no or narrow ribbing) it is preferred that the depth of the crease be towards the higher end of the range indicated above. Further, if the wall thickness of the leg is not great (e.g. if the small radiused portion of the leg is of a wall thickness of between about 0.2 to 0.3 mm) then again it would be preferred that the depth of the crease be towards the higher end of the range indicated above preferably coupled with a small width to depth ratio. The length of the crease for both aesthetic and functional reasons is preferably of such length that it does not extend more than about one third of the distance up the leg. In a petaloid configuration, the crease preferably does not extend substantially past the tangent point.

The container is preferably made from a polyester such as PET. Preferably bottle grade PET copolymer or homopolymer is used. However, the invention can be used with other plastics materials known in the art for manufacturing plastic bottles and include multilayer structures such as those incorporating regrind PET.

BRIEF DESCRIPTION OF DRAWINGS

The invention is described in further detail by reference to a particular embodiment and by comparison with a bottle formed without the required leg crease by reference to the following drawings in which.

DETAILED DESCRIPTION OF PREFERRED EMBODIMENTS

Figure 1:
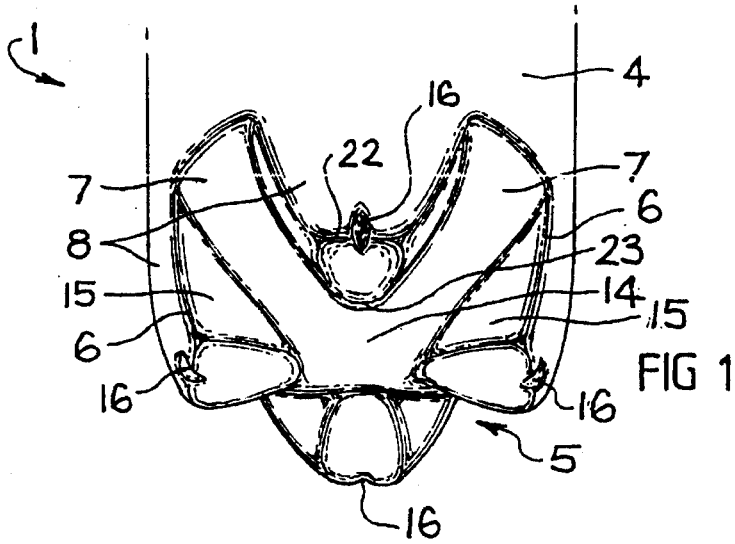
FIG. 1 is a perspective view of the base of a bottle made in accordance with the invention.
Figure 2:
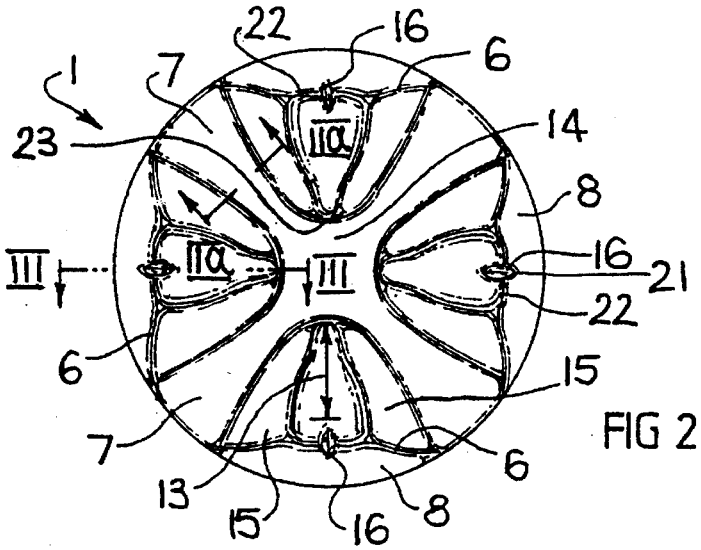
FIG. 2 is a plan view of the base of the container shown in FIG. 1.
Figure 2A:
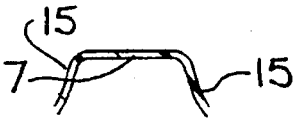
FIG. 2*a* is a transverse cross sectional view of that part of the base through IIa—IIa as shown in FIG. 2.
Figure 5A:
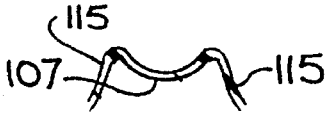
FIG. 5*a* is a transverse cross sectional view of part of the base through Va—Va as shown in FIG. 5.
Figure 3:
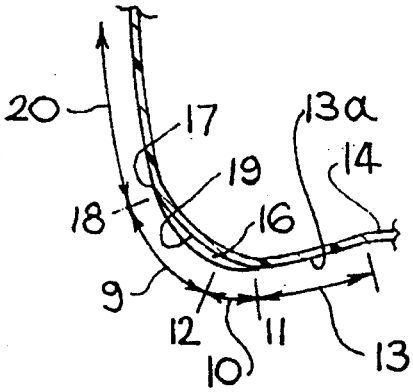
FIG. 3 is a cross-sectional view of part of the base through III—III as shown in FIG. 2.

In FIG. 1 there is shown the base of a bottle 1. Whilst not shown, such a bottle would conventionally comprise a substantially cylindrical side wall and a neck having a screw thread profile. The container has a body 4 and a self supporting base structure 5 which in this embodiment comprises four legs 6 which are integral with the container body 4. Legs 6 are spaced uniformly about the base of the container, are of substantially the same size and profile and are each separated by respective ribs 7 and dome 14. This invention is not limited to the shape of the legs or the utilization of ribs between these legs. However, in the embodiment shown, ribs 7 are provided and can be either flat or slightly hemispherical in transverse section. In the embodiment shown in FIG. 2, the ribs have a flat transverse section as can be seen by reference to FIG. 2*a*. In the alternative embodiment shown in FIG. 5, the ribs 107 have a slightly hemispherical section as can be seen in FIG. 5*a*. In the embodiment shown, the legs are of a conventional petaloid shape. As can be seen in FIG. 2, and 3, this comprises a front wall 8 which narrows as it extends downwardly, a small radiused portion 9, a foot portion 10 which has an inner edge 11 and an outer edge 12, a base portion 13, and side wall portions 15.

On each leg, there is provided a small longitudinal crease 16 which extends from the inner edge of the foot portion 11 and extends upwardly to a point 17 which is just beyond tangent point 18. In an alternative embodiment (not shown), the crease can extend into base portion 13 provided that it does not extend substantially into this portion (i.e. beyond the midway point 13*a*). The base of the crease 19 forms a smooth curve commencing at the surface of the leg at point 17 which extends inwardly to the inner edge 11 of the foot portion 10. Preferably, the bottom of the crease is a curve of substantially uniform radius. Tangent point 18 is the point at which the radius of curvature of the leg side wall markedly changes from a large radiused profile (outer leg portion 20) to a small radiused profile (small radiused portion 9) leading into the foot portion 10.

With reference to FIG. 2, it can be seen that the crease 16 is substantially "V" shaped coming to a point 21 located midway between side walls 15. In the embodiment shown, the crease has the following characteristics Width to Depth Ratio: 1.5:1

Depth (at deepest point): 2.0 mm

It will be appreciated from the above that the crease is small in proportion to the size of the leg. If it is much larger that the preferred ranges indicated earlier in this specification, it becomes difficult using conventional blowing apparatus to entirely blow out the corners of the respective legs. Notwithstanding the size of the crease, the applicants have found that it serves to control the location of creep in the bottom of the leg so that no unwanted bulging or folding occurs across the profile of the leg.

It will be noted from FIG. 1 that the bottle, when standing, is supported on two separate support portions 22 and 23 on each leg.

The applicants have found that on filling such a bottle with a carbonated beverage under pressure of four volumes of $CO_2$, there is creep which leads to further blowing out of the portions of the leg adjacent to the crease 16 but that no additional fold or distortion is created in the leg which is focussed on the pre-existing crease 16.

Figure 4:
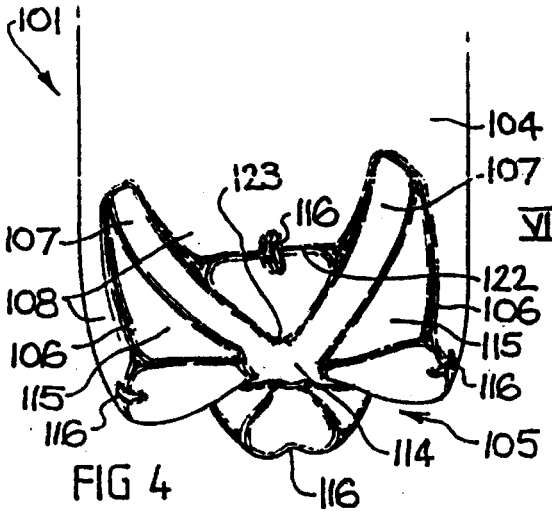
FIG. 4 is a perspective view of the base of a different bottle made in accordance with the invention.
Figure 5:
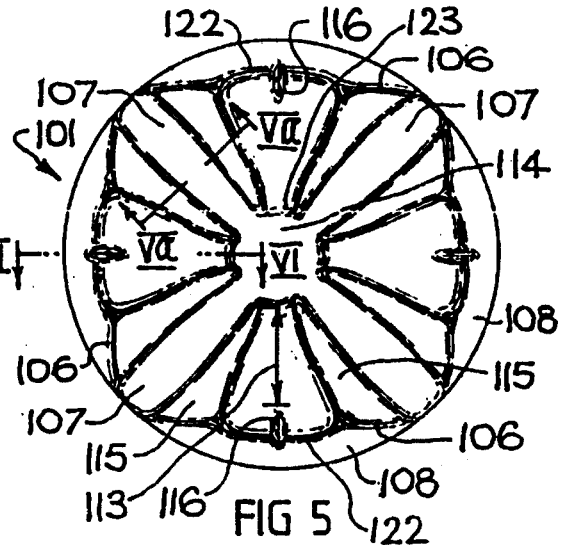
FIG. 5 is a plan view of the base of the base of the container shown in FIG. 4.
Figure 6:
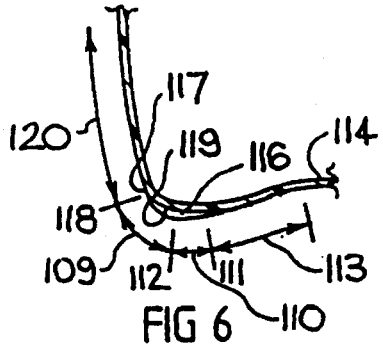
FIG. 6 is a cross-sectional view of part of the base through VI—VI as shown in FIG. 5.

FIGS. 4 to 6 show an alternative embodiment of the invention where the design profile of the base is modified from that shown in FIGS. 1 to 3. In particular, the foot of each leg is of increased proportion and is of a flatter profile. Like features are indicated by the same numbers increased by 100. It will be noted that crease 116 extends into base portion 113 to a small extent. It does not extend more than half way into this portion of the leg 106.

Figure 7:
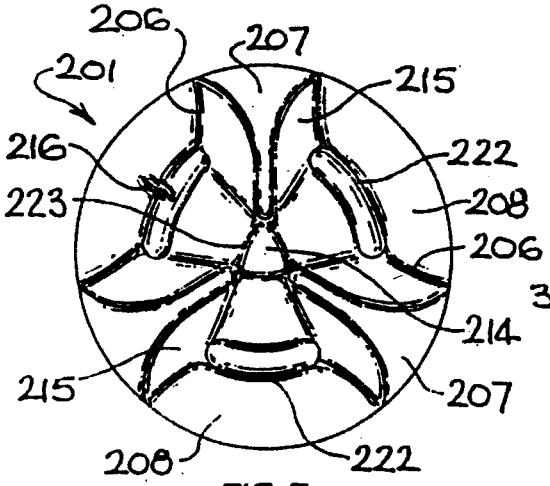
FIG. 7 is a plan view of the base of one particular prior bottle design to which the present invention can conveniently be incorporated.

In FIG. 7, there is shown a bottle design which has been previously proposed in U.S. Pat. No. 4,867,323. This bottle configuration can be enhanced by incorporating the features of the present invention. Like features to the bottles of the present invention are indicated by the same numbers increased by 200 and on one of the legs a crease 216 is shown as it would be incorporated in such a base design if incorporating the present invention.

Figure 8:
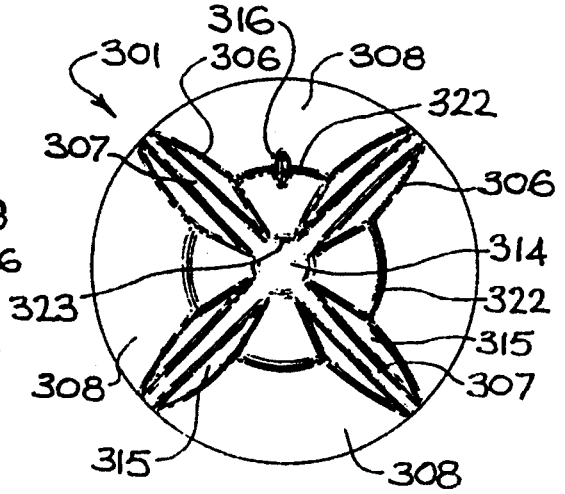
FIG. 8 is a plan view of the base of a second prior bottle design to which the present invention can conveniently be incorporated.

In FIG. 8, there is shown a second alternative prior base configuration. An example of such a base is revealed in U.S. Pat. No. 4,978,015. Like features of this base are indicated by the same numbers increased by 300. The aesthetic and functional performance of such a base would be enhanced by the present invention and one of the legs is shown incorporating a crease 316 of the type as provided by the present invention.

Figure 9:
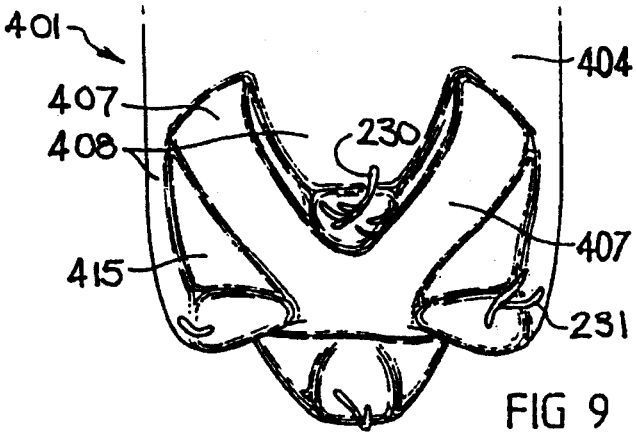
FIG. 9 is a perspective view of a bottle identical in all respects to the bottle shown in FIG. 1 except that it has been made without any crease in the leg side wall and has been filled with a carbonated beverage under normal carbonation pressure and thereafter emptied.

For the purposes of comparison, the applicants made a bottle in all respects the same as that shown in FIG. 1 without crease 16 in the leg profile. A representation of the base of this bottle is shown in FIG. 9. Various aspects of the base of this bottle are likewise shown and are numbered to identify like features with the bottle earlier described by like numerals increased by 400. This bottle was filled with a carbonated soft drink and capped at a pressure of four volumes of $CO_2$. After the container had been allowed to equilibrate for a period of one hour, the bottle was opened, the contents emptied and the bottle examined. It was discovered that each of the legs were subject to some deformation as a result of creep. The extent of this deformation differed from leg to leg and occured in slightly different places. Prominent ridges 230 and 231 were formed on two of the legs. These ridges were not centrally located and extended at an angle from one side of the foot portion up part of the container leg wall. These ridges were sufficiently pronounced that the container when placed on a level surface was supported on the ridges rather than on any other surface of the foot portion. With respect to the other two legs, the ridging was not so pronounced. As a result, the container did not sit flatly and had the appearance of being mis-manufactured.

Further modifications, additions or alterations may be made to the design profile as hereinbelow described without departing from the spirit or ambit of the present invention as defined in the following claims. In particular, the invention is useful in relation to a broad range of container feet profiles and it is possible to utilize more than one crease to meet the objectives of the invention.

I claim:

1. A plastics container comprising a neck and an outlet opening, a container body and a base; the base comprising a plurality of circumferentially spaced legs with each leg terminating in a foot portion on which the container is adapted to stand; each foot portion having an inner edge being that edge of the foot portion closest to the center of the base; each of the legs of the container further including a base portion which extends from the inner edge of the foot portion towards the center of the base; each base portion being configured such that it makes no contact with a level surface when the container is standing upright on such a surface; wherein each leg of the container includes at least one longitudinal crease which extends radially inwardly towards the center of the base but which does not extend more than halfway along the base portion.

2. A container as claimed in claim 1 wherein the at least one longitudinal crease on each leg is comprised of a single crease which extends downwardly and inwardly at least to the extent necessary so to substantially divide the foot portion of each leg into two separate support portions on which the container is adapted to stand.

3. A container as claimed in claim 2 wherein each crease is substantially "V" shaped in cross section when viewed in cross section transverse to the crease.

4. A container as claimed in claim 2 in which each of the legs of the container comprise two side walls and a front wall, the front wall of each leg reducing in width towards the foot portion of the leg.

5. A container as claimed in claim 1 wherein each crease is substantially "V" shaped in cross section when viewed in cross section transverse to the crease.

6. A container as claimed in claim 5 in which each of the legs of the container comprise two side walls and a front wall, the front wall of each leg reducing in width towards the foot portion of the leg.

7. A container as claimed in claim 1 in which each of the legs of the container comprise two side walls and a front wall, the front wall of each leg reducing in width towards the foot portion of the leg.

8. A container as claimed in claim 7 wherein the crease on each leg does not extend more than about one third of the distance up the front wall of the leg.

9. A container as claimed in claim 8 wherein the front wall of each leg is gradually curved to a tangent point below which the front wall comprises a small radiused portion in which the front wall curves with a substantially reduced radius of curvature to the outer edge of the foot portion and wherein the crease in each leg extends substantially longitudinally along at least most of the small radiused portion.

10. A container as claimed in claim 9 wherein the crease in each leg extends from the outer edge of the foot portion to at least the tangent point.

11. A container as claimed in claim 10 wherein the at least one longitudinal crease on each leg is comprised of a single crease which is located centrally down the leg.

12. A container as claimed in claim 9 wherein the width to depth ratio of the crease in at least the small radiused portion is from 1:1 to 3:1.

13. A container as claimed in claim 12 wherein the width of the crease in each leg is between 5 to 20% of the maximum width of the foot portion of the leg.

14. A container as claimed in claim 1 wherein the capacity of the container is between 1.0 to 2.0 liters and wherein the crease on each respective leg has a maximum depth of between 0.5 to 3.0 mm.

15. A container as claimed in claim 14 made from a polyester.

16. A container as claimed in claim 15 wherein each of the legs of the container are separated by ribs being of flat transverse section.

17. A container as claimed in claim 15 wherein each of the legs of the container are separated by ribs being of slightly hemispherical transverse section.

18. A container as claimed in claim 1 in which the center of the base is a dome portion and the base portion of each leg extends from the dome portion to the inner edge of the foot portion.

* * * * *